US008529016B2

(12) United States Patent
Takeda

(10) Patent No.: US 8,529,016 B2
(45) Date of Patent: Sep. 10, 2013

(54) LIQUID EJECTION APPARATUS, CONTROLLER THEREFOR, NONVOLATILE STORAGE MEDIUM STORING PROGRAM TO BE EXECUTED BY THE APPARATUS

(75) Inventor: Kengo Takeda, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/344,398

(22) Filed: Jan. 5, 2012

(65) Prior Publication Data

US 2012/0176444 A1 Jul. 12, 2012

(30) Foreign Application Priority Data

Jan. 6, 2011 (JP) ..... 2011-001054

(51) Int. Cl.
*B41J 2/165* (2006.01)

(52) U.S. Cl.
USPC ..... 347/28

(58) Field of Classification Search
USPC ..... 347/28
See application file for complete search history.

(56) References Cited

U.S. PATENT DOCUMENTS

| | | | | |
|---|---|---|---|---|
| 5,557,306 | A * | 9/1996 | Fukushima et al. | 347/33 |
| 6,056,387 | A * | 5/2000 | Kaneko | 347/23 |
| 6,511,152 | B2 * | 1/2003 | Yoshimura | 347/33 |
| 7,516,837 | B2 * | 4/2009 | Teshima et al. | 198/495 |
| 2004/0046852 | A1 * | 3/2004 | Pham et al. | 347/104 |
| 2005/0168521 | A1 * | 8/2005 | Suzuki et al. | 347/33 |
| 2006/0119688 | A1 * | 6/2006 | Shigemura | 347/104 |
| 2006/0192809 | A1 * | 8/2006 | Nakashima | 347/22 |
| 2007/0279451 | A1 * | 12/2007 | Mizoguchi et al. | 347/33 |
| 2008/0278538 | A1 * | 11/2008 | Tokuno | 347/33 |
| 2008/0283092 | A1 * | 11/2008 | Nagai et al. | 134/6 |
| 2009/0046123 | A1 * | 2/2009 | Muraoka | 347/33 |
| 2009/0073222 | A1 * | 3/2009 | Hori | 347/33 |
| 2011/0050801 | A1 * | 3/2011 | Uemura | 347/33 |

FOREIGN PATENT DOCUMENTS

JP 2004-130719 A 4/2004

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A liquid ejection apparatus including: a head having an ejection face having openings through which recording liquid is ejected; a conveyance member having a face that is disposed so as to be opposed to the ejection face and that is moved while supporting a recording medium to convey the recording medium; a cleaning-liquid supply portion configured to supply cleaning liquid onto the face; a wiper movable relative to the face while contacting the face to remove the recording liquid on the face; and a cleaning-operation executing section configured to execute a first cleaning operation including a first operation for reducing an amount of the recording liquid on the face and a second operation in which the cleaning liquid is supplied onto the face after the first operation, and then the recording liquid and the cleaning liquid on the face are removed by the wiper.

15 Claims, 10 Drawing Sheets

LIQUID EJECTION APPARATUS, CONTROLLER THEREFOR, NONVOLATILE STORAGE MEDIUM STORING PROGRAM TO BE EXECUTED BY THE APPARATUS

CROSS REFERENCE TO RELATED APPLICATION

The present application claims priority from Japanese Patent Application No. 2011-001054, which was filed on Jan. 6, 2011, the disclosure of which is herein incorporated by reference in its entirety.

BACKGROUND OF THE INVENTION

1. Field of the Invention

The present invention relates to a liquid ejection apparatus configured to eject liquid such as ink, a controller used therefor, and a nonvolatile storage medium storing a program to be executed by the liquid ejection apparatus.

2. Description of the Related Art

There is known a liquid ejection apparatus configured to supply cleaning liquid onto a face of a conveyance member and remove or wipe foreign matters (such as recording liquid (e.g., ink) and paper dust) together with the cleaning liquid by a wiper. In this liquid ejection apparatus in the form of an ink-jet recording apparatus, the cleaning liquid is supplied onto a face of a conveyance belt (conveyance member), and foreign matters are removed together with the cleaning liquid by a blade (wiper).

SUMMARY OF THE INVENTION

However, in this liquid ejection apparatus, when the recording liquid and the cleaning liquid are mixed with each other on the face of the conveyance member, cleaning ability of the cleaning liquid decreases, making it difficult to perform good wiping.

This invention has been developed in view of the above-described situations, and it is an object of the present invention to provide a liquid ejection apparatus capable of performing good wiping while preventing cleaning ability of cleaning liquid from decreasing, a controller used in the liquid apparatus, and a nonvolatile storage medium storing a program to be executed by the liquid ejection apparatus.

The object indicated above may be achieved according to the present invention which provides a liquid ejection apparatus comprising: a liquid ejection head having an ejection face in which a plurality of ejection openings are formed, the liquid ejection head being configured to eject recording liquid through the plurality of ejection openings; a conveyance member having a face that is disposed so as to be opposed to the ejection face and that is moved while supporting a recording medium thereon to convey the recording medium; a cleaning-liquid supply portion configured to supply cleaning liquid onto the face; a wiper movable relative to the face while contacting the face to remove the recording liquid existing on the face; and a cleaning-operation executing section configured to execute a first cleaning operation including (i) a first operation for reducing an amount of the recording liquid on the face and (ii) a second operation in which the cleaning liquid is supplied onto the face by the cleaning-liquid supply portion after the that operation, and then the recording liquid and the cleaning liquid on the face are removed by the wiper.

The object indicated above may be achieved according to the present invention which provides a controller for a liquid ejection apparatus, the liquid ejection apparatus comprising:

a liquid ejection head having an ejection face in which a plurality of ejection openings are formed, the liquid ejection head being configured to eject recording liquid through the plurality of ejection openings; a conveyance member having a face that is disposed so as to be opposed to the ejection face and that is moved while supporting a recording medium thereon to convey the recording medium; a cleaning-liquid supply portion configured to supply cleaning liquid onto the face; and a wiper movable relative to the face while contacting the face to remove the recording liquid existing on the face, the controller comprising: a cleaning-operation executing section configured to execute a first cleaning operation including (i) a first operation for reducing an amount of the recording liquid on the face and (ii) a second operation in which the cleaning liquid is supplied onto the face by the cleaning-liquid supply portion after the first operation, and then the recording liquid and the cleaning liquid on the face are removed by the wiper.

The object indicated above may be achieved according to the present invention which provides a nonvolatile storage medium storing a program to be executed by a liquid ejection apparatus, the liquid ejection apparatus comprising: a liquid ejection head having an ejection face in which a plurality of ejection openings are formed, the liquid ejection head being configured to eject recording liquid through the plurality of ejection openings; a conveyance member having a face that is disposed so as to be opposed to the ejection face and that is moved while supporting a recording medium thereon to convey the recording medium; a cleaning-liquid supply portion configured to supply cleaning liquid onto the face; and a wiper movable relative to the face while contacting the face to remove the recording liquid existing on the face, the program being designed to execute a first cleaning operation including (i) a first operation for reducing an amount of the recording liquid on the face and (ii) a second operation in which the cleaning liquid is supplied onto the face by the cleaning-liquid supply portion after the first operation, and then the recording liquid and the cleaning liquid on the face are removed by the wiper.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIGS. 10A-10E are side views generally showing processings in a first sequence, wherein FIG. 10A shows a middle of the first step, FIG. 10B shows a completion of the first step, FIG. 10C shows a middle of a wiper cleaning, FIG. 10D shows a liquid supply in the second step, and FIG. 10E shows a start of wiping in the second step.

DETAILED DESCRIPTION OF THE EMBODIMENTS

Hereinafter, there will be described embodiments of the present invention by reference to the drawings.

Figure 1:
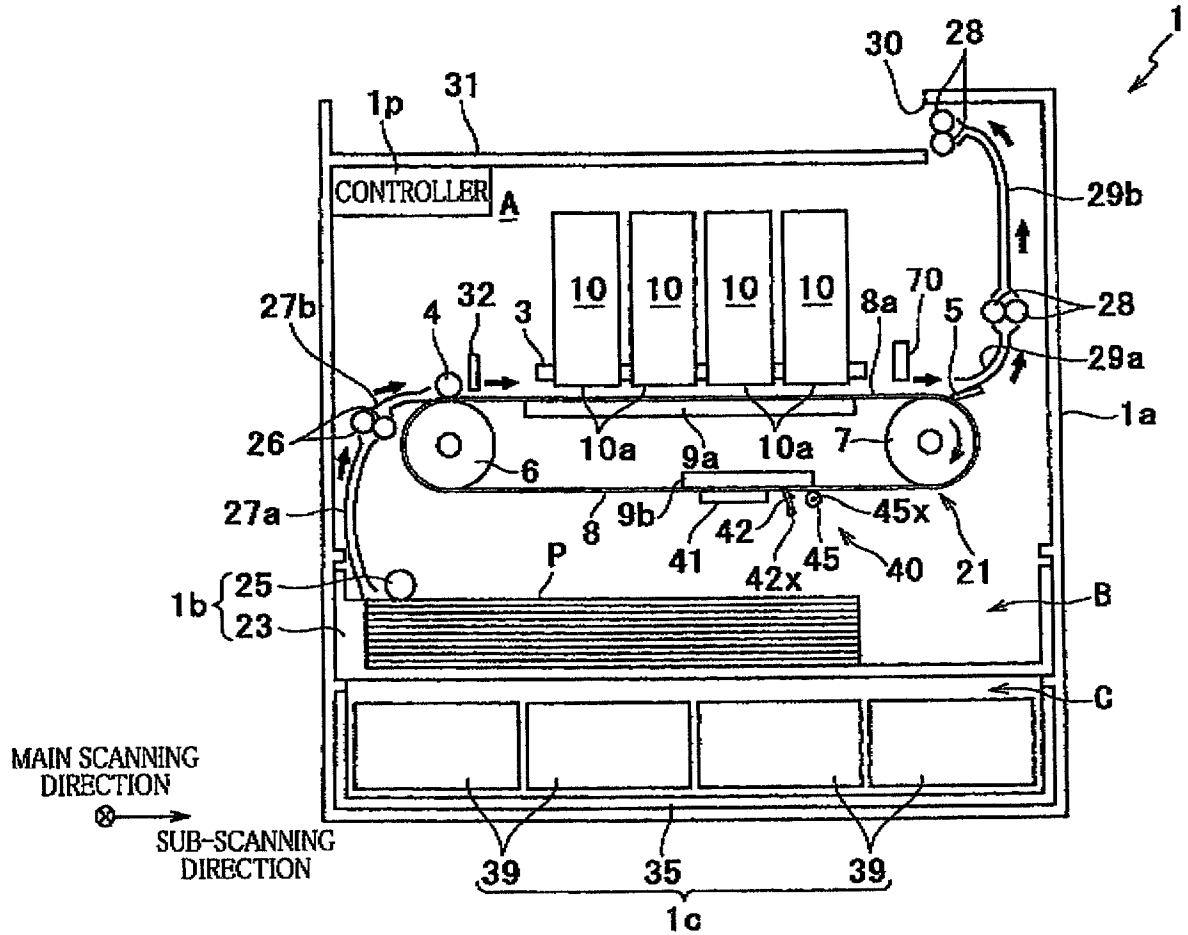
FIG. 1 is a side view generally showing an internal structure of an ink-jet printer as a first embodiment of a liquid ejection apparatus to which the present invention is applied.

First, there will be explained an overall construction of an ink-jet printer 1 as a first embodiment of a liquid ejection apparatus of the present invention with reference to FIG. 1.

The printer 1 includes a casing 1*a* having a rectangular parallelepiped shape. A sheet-discharge portion 31 is provided at an upper portion of a top plate of the casing 1*a*. An inner space of the casing 1*a* is divided into spaces A, B, and C in order from an upper side thereof. A sheet-supply unit 1*b* is disposed in the space B. In the spaces A, B is formed a sheet conveyance path extending from the sheet-supply unit 1*b* to the sheet-discharge portion 31.

In the space A, there are disposed a sheet sensor 32, the four heads 10, a cleaning-liquid supply device 70 (as one example of a cleaning-liquid supply portion), a conveyance unit 21, a guide unit, a wiping unit 40, a controller 1*p*, and so on.

The sheet-convey unit 21 includes: (a) belt rollers 6, 7; (b) an endless conveyance belt 8 (as one example of a conveyance member) wound around the rollers 6, 7; (c) a nip roller 4 and a peeling plate 5 disposed outside the conveyance belt 8; (d) platens 9*a*, 9*b* disposed inside the conveyance belt 8; and so on. The belt roller 7 is a drive roller which is rotated in a clockwise direction in FIG. 1 by a drive power of a conveyance motor 121 (see FIG. 8). The rotation of the belt roller 7 rotates or circulates the conveyance belt 8 in its circumferential direction in FIG. 1. The belt roller 6 is a driven roller which is rotated in the clockwise direction in FIG. 1 in accordance with the rotation of the conveyance belt 8. The nip roller 4 is disposed so as to face the belt roller 6 and used for pressing a sheet P (as one example of a recording medium) supplied from an upstream-side guide portion (which will be explained below), onto a face 8*a* of the conveyance belt 8. The peeling plate 5 is disposed so as to face the belt roller 7 and used for peeling off the sheet P from the face 8*a* to guide the sheet P toward a downstream-side guide portion (which will be explained below). The platen 9*a* is disposed so as to face the four heads 10 and to support an upper portion (an upper loop) of the conveyance belt 8 from an inside thereof. As a result, a predetermined space appropriate for recording is formed between the face 8*a* and lower faces (ejection faces 10*a*) of the respective heads 10.

Each head 10 (as one example of a liquid ejection head) is a line head having a generally rectangular parallelepiped shape elongated in a main scanning direction. In recording (forming an image), the four heads 10 respectively eject inks (each as one example of a recording liquid) of four colors, namely, magenta, cyan, yellow, and black, from the lower faces (the ejection faces 10*a*) thereof. The four heads 10 are arranged in a sub-scanning direction (perpendicular to the main scanning direction) at predetermined pitches and supported by the casing 1*a* via a frame 3.

The guide unit includes the upstream-side guide portion and the downstream-side guide portion disposed on opposite sides of the conveyance unit 21. The upstream-side guide portion includes two guides 27*a*, 27*b* and a pair of conveyance rollers 26. The upstream-side guide portion connects the sheet-supply unit 1*b* and the conveyance unit 21 to each other. The downstream-side guide portion includes two guides 29*a*, 29*b* and two pairs of conveyance rollers 28. The downstream-side guide portion connects the conveyance unit 21 and the sheet-discharge portion 31 to each other.

The cleaning-liquid supply device 70 includes a tank storing cleaning liquid therein and a multiplicity of nozzles communicating with the tank and opening in a lower face of the device 70. The cleaning-liquid supply device 70 ejects the cleaning liquid from the nozzles onto the face 8*a*. The cleaning liquid may be any liquid as long as the liquid is suitable for cleaning the face 8*a*. For example, water, clear ink (e.g., colorless transparent liquid not containing dyes or pigments, or the like) is used as the cleaning liquid.

The wiping unit 40 includes a sub-wiper 41, a wiper 42, a sub-wiper cleaner 44 (see FIG. 6), and a wiper cleaner 45. The wiper 42 and the wiper cleaner 45 are disposed so as to be opposed to the face 8*a* of a lower loop (portion) of the conveyance belt 8. In the wiping, the sub-wiper 41, while contacting the face 8*a* of the lower loop, is moved in the main scanning direction from its home position located on one side of the lower loop of the conveyance belt 8. The sub-wiper cleaner 44 (see FIG. 6) is disposed on the other side of the lower loop of the conveyance belt 8 (the sub-wiper cleaner 44 is disposed on the other side of the lower loop from the home position of the sub-wiper 41). The platen 9*b* is disposed inside the conveyance belt 8 at a position located on the other side of the conveyance belt 8 from a portion thereof contacted by the wipers 41, 42 in the wiping. Since the platen 9*b* supports the lower loop of the conveyance belt 8 from the inside thereof, it is possible to prevent the conveyance belt 8 from being deformed by pressing forces of the wipers 41, 42 in the wiping of the wipers 41, 42, resulting in good wiping.

The sheet-supply unit 1*b* includes a sheet-supply tray 23 and a sheet-supply roller 25. The sheet-supply tray 23 is mountable on and removable from the casing 1*a*. The sheet-supply tray 23 has a box shape opening upward and can accommodate various sizes of sheets P. The sheet-supply roller 25 supplies, to the upstream-side guide portion, an uppermost one of the sheets P in the sheet-supply tray 23.

The controller 1*p* controls operations of the components of the printer 1 to control entire operations of the printer 1.

In order to record an image on the sheet P on the basis of image data supplied from an external device such as a PC connected to the printer 1, the controller 1*p* controls: a preliminary operation for the recording; the supplying, conveying, and discharging of the sheet P; an ink ejecting operation synchronized with the conveyance of the sheet P; and other operations for the recording. Specifically, on the basis of a recording command received from the external device, the controller 1*p* controls driving devices for driving: a sheet supply motor 125 (see FIG. 8) for the sheet-supply roller 25; a conveyance motor 127 (see FIG. 8) for the conveyance rollers of the guide portions; the conveyance motor 121 (see FIG. 8), the heads 10; and so on. The sheet P supplied from the sheet-supply tray 23 is conveyed to the conveyance unit 21 by the conveyance rollers 26. When the sheet P passes through a position just under the heads 10 in the sub-scanning direction, the heads 10 respectively eject inks of respective colors to form a color image on the sheet P. The ink ejecting operation for the recording is performed on the basis of a detection signal transmitted from the sheet sensor 32 for sensing a leading end of the sheet P. The sheet P is then peeled off from the peeling plate 5 and conveyed upward by the two conveyance rollers 28. Further, the sheet P is discharged onto the sheet-discharge portion 31 through an opening 30 formed in an upper portion of the printer 1.

Here, the sub-scanning direction is a direction parallel to a direction (a part of a conveyance direction) in which the sheet P conveyed by the conveyance unit 21 is conveyed through the position just under the heads 10, and the main scanning direction is a direction parallel to the horizontal plane and perpendicular to the sub-scanning direction.

As will be described below, the controller 1*p* executes controls for wiping and removing foreign matters (such as the ink and paper dust) from the face 8*a* of the conveyance belt 8.

In the space C, a cartridge unit 1*c* is disposed so as to be mountable on and removable from the easing 1*a*. The cartridge unit 1*c* includes a tray 35 and four cartridges 39 accommodated in the tray 35 side by side. The cartridges 39 respectively store the inks of four colors and respectively communicate with the heads 10 via tubes, not shown. The inks stored in the respective cartridges 39 are supplied to the respective heads 10 at appropriate timings.

Figure 2:
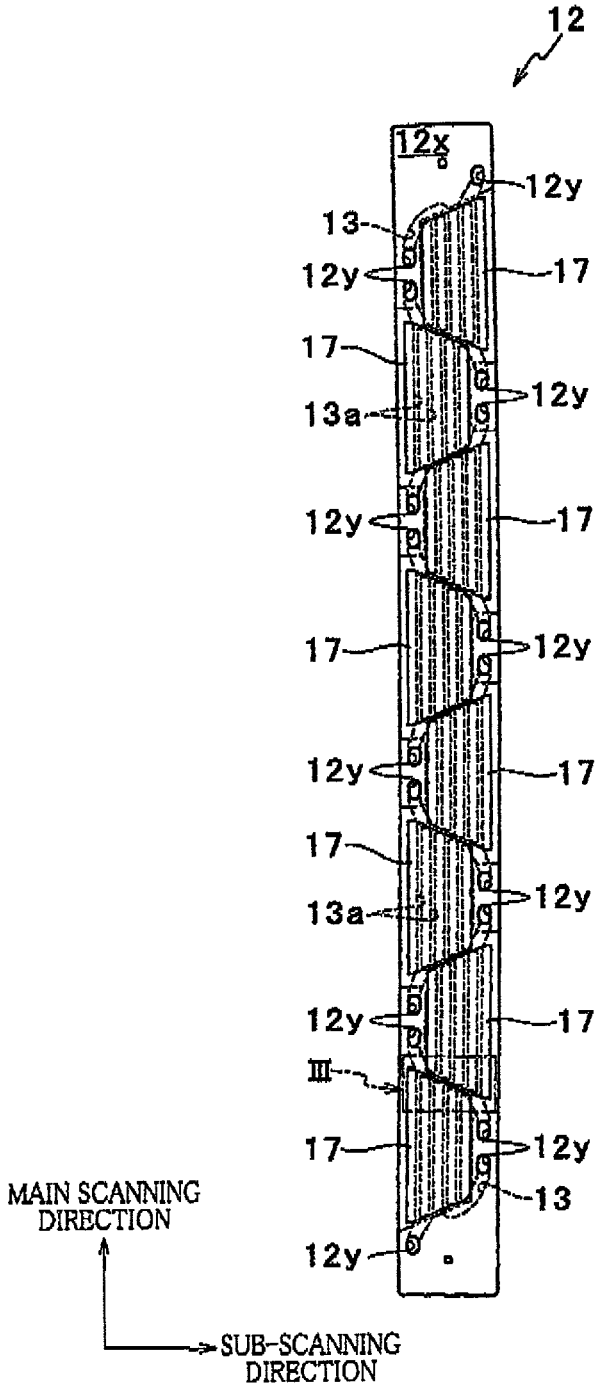
FIG. 2 is a plan view showing a channel unit and actuator units of an ink-jet head of the printer in FIG. 1.
Figure 3:
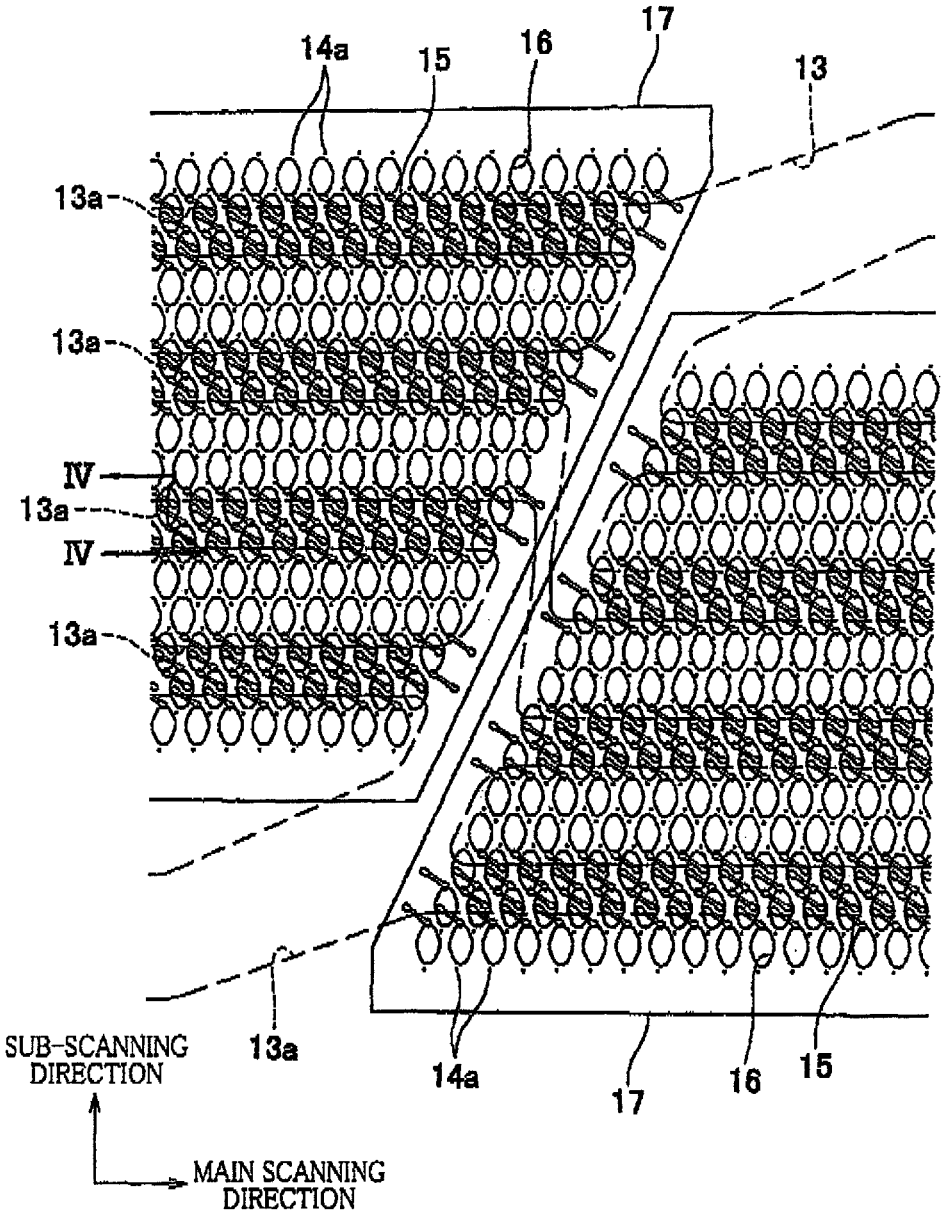
FIG. 3 is an enlarged view showing an area III enclosed by a one-dot chain line in FIG. 2.
Figure 4:
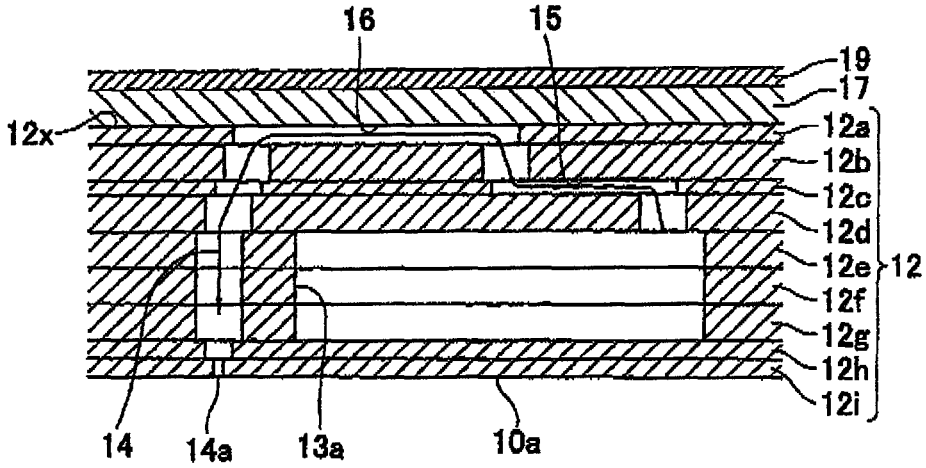
FIG. 4 is a partial cross-sectional view taken along line IV-IV in FIG. 3.

There will be next explained the construction of each head 10 with reference to FIGS. 2-4 in detail. It is noted that, in FIG. 3, pressure chambers 16 and apertures 15 are illustrated by solid lines for easier understanding purposes though these elements are located under the actuator units 17 and thus should be illustrated by broken lines. It is further noted that, since the four heads 10 have the same construction, the following explanation will be given for one of the heads 10 for the sake of simplicity.

The head 10 is a stacked body including: a reservoir unit, not shown; a channel unit 12; eight actuator units 17 fixed to an upper face 12*x* of the channel unit 12 (see FIG. 2); Flexible Printed Circuits (FPCs, see FIG. 4) 19 bonded to the respective actuator units 17; and so on which are stacked in an upward and downward direction. The reservoir unit has a channel including a reservoir for temporarily storing the ink supplied from the cartridge 39 (see FIG. 1). The channel unit 12 has channels each extending from a corresponding one of openings 12*y* (see FIG. 2) formed in the upper face 12*x* to a corresponding one of ejection openings 14*a* formed in the lower face (the ejection face 10*a*). Each of the actuator units 17 has piezoelectric actuators respectively for the ejection openings 14*a*.

Projections and recesses are formed on and in a lower face of the reservoir unit. The projections are bonded to areas of the upper face 12*x* of the channel unit 12 on which the actuator units 17 are not disposed (i.e., areas including the openings 12*y* and enclosed by two-dot chain lines in FIG. 2). A distal end face of each of the projections has an opening connected to the reservoir and opposed to a corresponding one of the openings 12*y* of the channel unit 12. As a result, individual channels 14 and the reservoir are communicated with each other via the above-described openings. The recesses are opposed to the upper face 12*x* of the channel unit 12, surfaces of the actuator units 17, and surfaces of the FPCs 19 with slight clearances therebetween.

The channel unit 12 is a stacked body constituted by nine metal rectangular plates 12*a*-12*i* (see FIG. 4) having generally the same size and bonded to one another. As shown in FIGS. 2, 3, and 4, the channels of the channel unit 12 include (a) manifold channels 13 respectively having the openings 12*y* at respective one ends, (b) sub-manifold channels 13*a* each branched from a corresponding one of the manifold channels 13, and (c) the individual channels 14 each extending from an outlet of a corresponding one of the sub-manifold channels 13*a* to a corresponding one of the ejection openings 14*a* via a corresponding one of the pressure chambers 16. As shown in FIG. 4, each of the individual channels 14 is formed for a corresponding one of the ejection openings 14*a* so as to have the aperture 15 functioning as a restrictor for adjusting a channel resistance. In areas of the upper face 12*x* to which the respective actuator units 17 are bonded, generally rhombic openings respectively for exposing the pressure chambers 16 are formed so as to be arranged in matrix. In areas of the lower face (the ejection face 10*a*) which are respectively opposed to the areas to which the respective actuator units 17 are bonded, the ejection openings 14*a* are formed in matrix in the same pattern as that of the pressure chambers 16.

As shown in FIG. 2, the actuator units 17 each having a trapezoid shape in plan view are arranged on the upper face 12*x* in two arrays in a staggered configuration. As shown in FIG. 3, each of the actuator units 17 covers the openings of the pressure chambers 16 formed in the area to which the actuator unit 17 is bonded. Though not shown in any figures, the actuator unit 17 includes: a plurality of piezoelectric layers expanding over a multiplicity of the pressure chambers 16; and electrodes interposing the piezoelectric layer in a thickness direction of the actuator unit 17. The electrodes include: individual electrodes provided for the respective pressure chambers 16; and a common electrode common for the pressure chambers 16. The individual electrodes are formed on a surface of an uppermost one of the piezoelectric layers.

Each of the FPCs 19 has wirings respectively corresponding to electrodes of the actuator unit 17, and driver ICs, not shown, are mounted on the wirings. One end of the FPC 19 is fixed to the actuator unit 17, and the other end thereof is fixed to a control board, not shown, of the head 10 (which is disposed on an upper side of the reservoir unit). Under the control of the controller 1*p* (see FIG. 1), the FPC 19 sends the driver ICs various drive signals outputted from the control board and sends the actuator units 17 signals produced by the driver ICs.

There will be next explained a construction of the wiping unit 40.

Figure 5A:
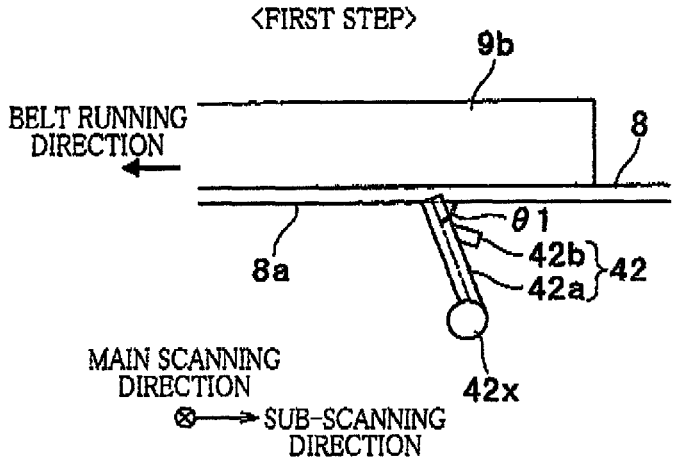
FIG. 5A is a side view partly showing a state of a wiper in a first step.
Figure 5B:
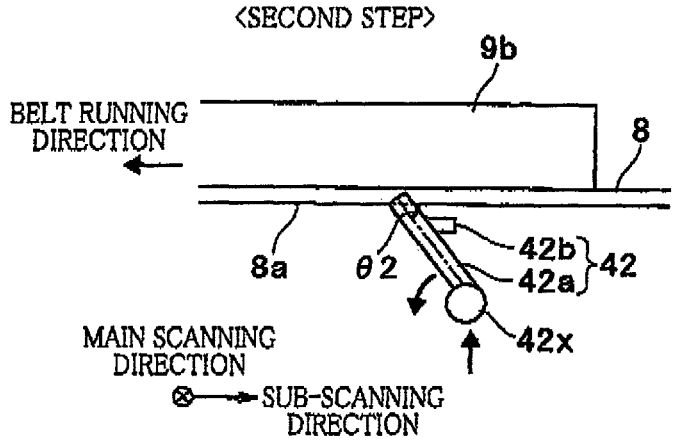
FIG. 5B is a side view partly showing a state of the wiper in a second step.

As shown in FIGS. 5A and 5B, the wiper 42 is constituted by a main body 42*a* and a wall 42*b*. The main body 42*a* and the wall 42*b* are formed of the same material (e.g., an elastic material such as a rubber) integrally with each other.

The main body 42*a* is a plate member mainly constitutes the wiper 42 and having a distal end (one end) contactable with the face 8*a* (i.e., a contactable portion of the wiper 42 which is contactable with the face 8*a*). A basal end (the other end) of the main body 42*a* is fixed to a shaft 42*x* extending in the main scanning direction. The main body 42*a* extends in the main scanning direction so as to be longer than the conveyance belt 8 in the main scanning direction (that is, a length of the main body 42*a* in the main scanning direction is longer than a width of the conveyance belt 8). Near the distal end of the main body 42*a*, the wall 42*b* is provided on a downstream face (right face in FIGS. 5A and 5B) of the main body 42*a* in a relative movement direction that is a direction in which the wiper 42 is moved relative to the face 8*a* in the wiping (hereinafter may be simply referred to as "relative movement direction"). As in the present embodiment, where the wiper 42 is stopped or at rest, and the conveyance belt 8 is moved, the relative movement direction is a direction opposite to a belt running direction of the conveyance belt 8 in which the conveyance belt 8 runs or is circulated. Where the conveyance belt 8 is stopped or at rest, and the wiper 42 is moved, the relative movement direction coincides with a direction of the movement of the wiper 42. Where the conveyance belt 8 is moved, and the wiper 42 is moved in a direction opposite to the belt running direction of the conveyance belt 8, the relative movement direction coincides with the direction of the movement of the wiper 42. The wall 42*b* projects from the downstream face of the main body 42*a* in a direction toward a downstream side thereof in the relative movement direction, and in a direction inclined toward the basal end of the main body 42*a* with respect to a direction perpendicular to the downstream face of the main body 42*a*. A length of the wall 42*b* in its projecting direction is shorter than a length of the main body 42*a* in a direction perpendicular to the shaft 42*x*. The wall 42*b* is provided so as to expand over an entire length of the main body 42*a* in the main scanning direction.

At times other than the wiping, the wiper 42 is located at a position distant from the conveyance belt 8, and in the wiping, the wiper 42 is located at a position at which the distal end of the main body 42*a* is held in deforming contact with the face 8*a*. In the wiping, the main body 42*a* is held in contact with an entire width of the face 8*a* so as to be inclined with respect to the face 8*a* as seen in the main scanning direction such that a lower portion of the main body 42*a* is located nearer to the downstream side thereof (i.e., a right side in FIG. 5) in the relative movement direction than an upper portion of the main body 42*a*. In other words, in the wiping, the main body 42*a* extends from the distal end thereof in a direction including a downward component in a vertical direction and a downstream component in the relative movement direction (i.e., a rightward and downward direction in FIG. 5). When the conveyance belt 8 is circulated in this state, the foreign matters on the face 8*a* are removed.

Figure 6:
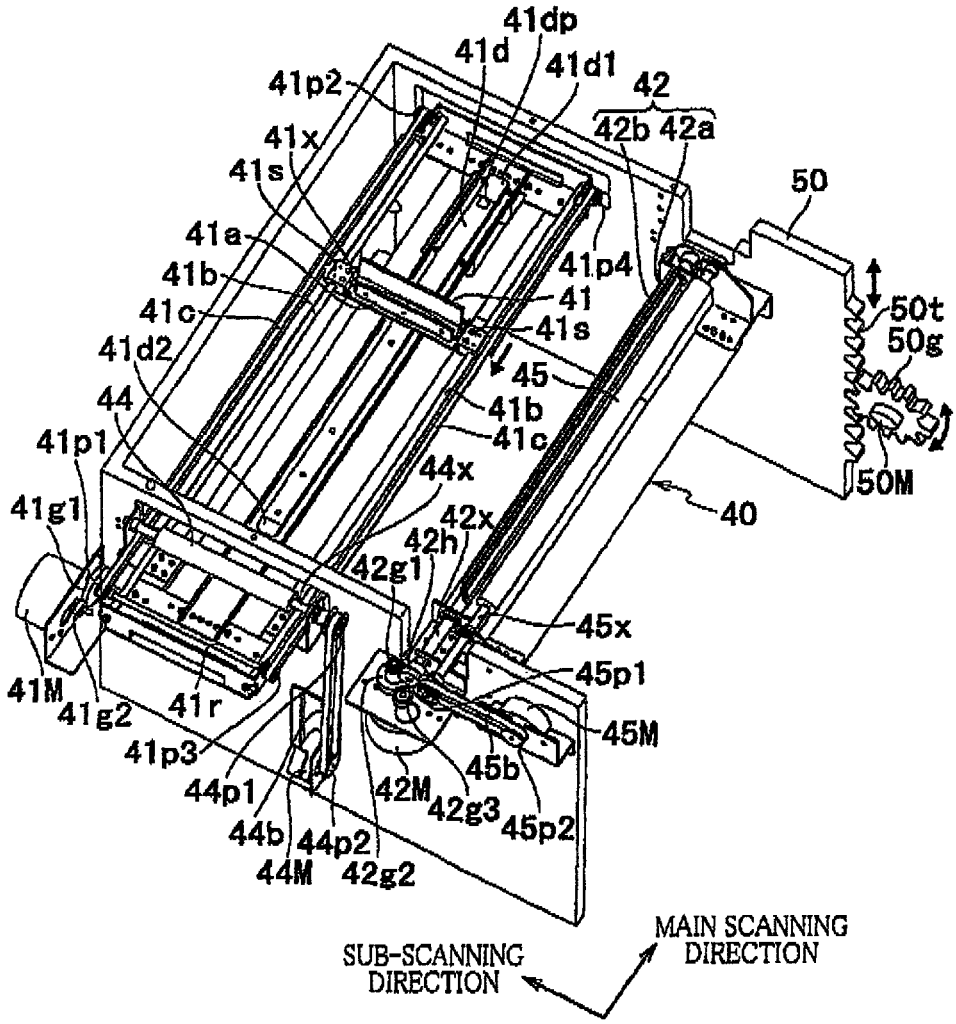
FIG. 6 is a perspective view showing a wiping unit.

As shown in FIG. 6, a worm wheel 42*h* is provided on one end of the shaft 42*x*. The worm wheel 42*h* is connected to a motor 42M via gears 42*g*1, 42*g*2, 42*g*3. The gears 42*g*3, 42*g*2, 42*g*1 are rotated by the motor 42M, which rotates the worm wheel 42*h* with the shaft 42*x*. In this rotation, the main body 42*a* is rotated about the shaft 42*x*, thereby changing an angle of the main body 42*a* with respect to the face 8*a* as shown in FIGS. 5A and 5B (i.e., inclination angles θ1, θ2 of the main body 42*a* with respect to the face 8*a* toward the downstream side thereof in the relative movement direction as seen in the main scanning direction). It is noted that the gears 42*g*1, 42*g*2, 42*g*3, the motor 42M, the worm wheel 42*h*, and the shaft 42*x* are examples of an angle adjusting mechanism.

As shown in FIG. 6, the sub-wiper 41 is a plate member formed of an elastic material such as a rubber and extending in the sub-scanning direction.

A basal end of the sub-wiper 41 (i.e., an end portion thereof opposite to a distal end thereof) is fixed to a supporter 41*a*. The supporter 41*a* is supported by a shaft 41*x* extending in the sub-scanning direction so as to be rotatable about the shaft 41*x*. A pair of sliders 41*s* are respectively provided on opposite ends of the shaft 41*x*. The sliders 41*s* are slidably supported on respective bars 41*b* each extending in the main scanning direction. To each of the sliders 41*s* is fixed a lower portion of a corresponding one of belts 41*c*. One of the belts 41*c* is wound around pulleys 41*p*1, 41*p*2, and the other of the belts 41*c* is wound around pulleys 41*p*3, 41*p*4. The pulleys 41*p*1, 41*p*3 are provided on opposite ends of a roller 41*r*. In addition to the pulley 41*p*1, a gear 41*g*1 rotatable integrally with the pulley 41*p*1 is provided on one of the opposite ends of the roller 41*r*. The gear 41*g*1 is connected to a motor 41M via a gear 41*g*2. When the pulley 41*p*1 is rotated by the motor 41M, the belts 41*c* are circulated. The sliders 41*s* are in turn slid along the bars 41*b*, whereby the supporter 41*a* is moved in the main scanning direction while supporting the sub-wiper 41. A plate 41*d* extending in the main scanning direction is disposed on a lower side of the supporter 41*a*. During the movement of the sub-wiper 41 in the main scanning direction, a lower end 41*a*1 of the supporter 41*a* is held in sliding contact with a face of the plate 41*d*. The face of the plate 41*d* is flat except opposite ends thereof in the main scanning direction. The plate 41*d* has: a step face 41*d*1 on one of the opposite ends thereof in the main scanning direction (i.e., an upstream end portion in a direction indicated by arrow in FIG. 6 in which the sub-wiper 41 is moved in its wiping); and an inclined face 41*d*2 on the other of the opposite ends thereof in the main scanning direction. The step face 41*d*1 is lower than the face of the plate 41*d* except the opposite ends thereof in the main scanning direction. A protruding portion 41*dp* is provided on the face of the plate 41*d* at a boundary between the step face 41*d*1 and the other area on the face of the plate 41*d* (except the step face 41*d*1). It is noted that the supporter 41*a* is urged in a clockwise direction in FIG. 7A by an urging member such as a spring.

Figure 7A:
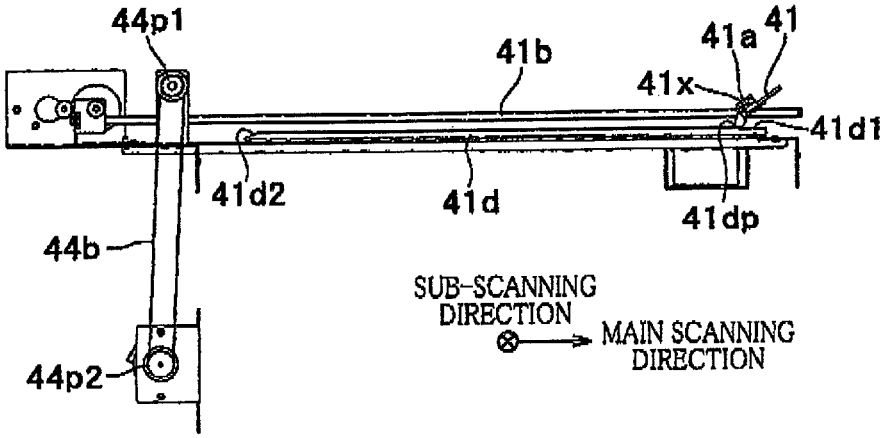
FIGS. 7A-7G are views for explaining operations of a sub-wiper in its wiping.
Figure 7B:
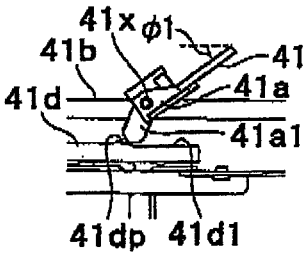
Figure 7C:
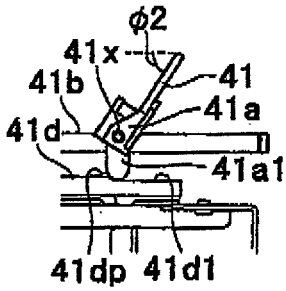
Figure 7D:
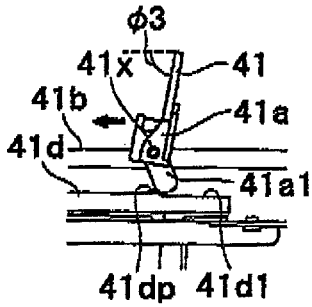
Figure 7E:
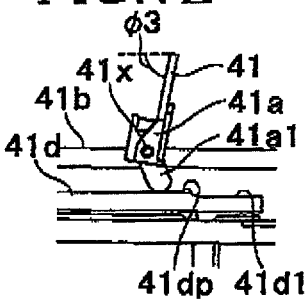
Figure 7F:
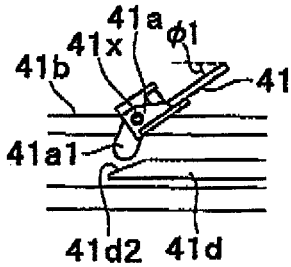
Figure 7G:
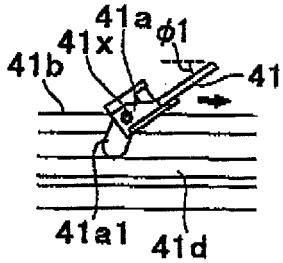

When the wiping is not performed, the sub-wiper 41 is positioned at the home position (see FIG. 7A). In this home position, the sub-wiper 41 is opposed to the face 8*a* in the vertical direction and is at rest at an angle ϕ1 (see FIG. 7B) with respect to the horizontal plane such that the distal end of the sub-wiper 41 does not contact the face 8*a*. When the sub-wiper 41 is to move from the home position in the main scanning direction by the motor 41M, as shown in FIGS. 7B, 7C, and 7D, the lower end 41*a*1 pivots or rotates while contacting an inclined face of the protruding portion 41*dp* near the step face 41*d*1. In this operation, the sub-wiper 41 pivots or rotates about the shaft 41*x* against an urging force of the urging member, whereby the angle of the sub-wiper 41 with respect to the horizontal plane is changed from ϕ1 to ϕ2 and then ϕ3 (ϕ1<ϕ2<ϕ3). As a result, the distal end of the sub-wiper 41 is brought into contact with the face 8*a*. Then, as shown in FIGS. 7D and 7E, the lower end 41*a*1 is moved over the protruding portion 41*dp*, and the sub-wiper 41 moves in the main scanning direction while keeping the angle ϕ3 to perform the wiping. During the wiping, the urging force of the urging member (i.e., a force in a direction directed so as to change the sub-wiper 41 from the angle ϕ2 to the angle ϕ1) is applied to the sub-wiper 41, but the sub-wiper 41 is kept at the angle ϕ3 because the lower end 41*a*1 is supported on the face of the plate 41*d*. When the sub-wiper 41 has reached the other end of the plate 41*d* in the main scanning direction, and the lower end 41*a*1 has reached the inclined face 41*d*2, as shown in FIG. 7F, the lower end 41*a*1 comes off or is released from the face of the plate 41*d* (the inclined face 41*d*2). In accordance with this operation, the sub-wiper 41 pivots or rotates about the shaft 41*x* by the urging force of the urging member, whereby the angle of the sub-wiper 41 is changed from ϕ3 to ϕ2 and then ϕ1. As a result, the distal end of the sub-wiper 41 comes off or is released from the face 8*a*, and the wiping of the sub-wiper 41 is completed. After the wiping, the sub-wiper 41 is moved in the main scanning direction (specifically in a direction in the wiping) at the angle ϕ1 to a position at which the distal end is brought into contact with the sub-wiper cleaner 44 (see FIG. 6). After the sub-wiper cleaner 44 has cleaned the distal end, the sub-wiper 41 is moved at the angle ϕ1 in a direction opposite to the direction in the wiping (see FIG. 7G) to return to the home position. It is noted that, in the wiping, the sub-wiper 41 is moved in the main scanning direction from one end to the other end of the conveyance belt 8 in its widthwise direction in the state in which the distal end is held in deforming contact with the face 8*a*. As a result, the foreign matters on the face 8*a* are removed.

The foreign matters removed by the wipers 41, 42 are received by respective receiving trays, not shown, located below the respective wipers 41, 42.

Each of the wiper cleaners 44, 45 (see FIG. 6) is a cylindrical member formed of a material capable of absorbing the ink such as a sponge. The wiper cleaners 44, 45 are used respectively for cleaning the distal ends of the respective wipers 41, 42. The sub-wiper cleaner 44 is elongated in the sub-scanning direction, and the wiper cleaner 45 is elongated in the main scanning direction. The sub-wiper cleaner 44 is longer than the sub-wiper 41 in the sub-scanning direction, and the wiper cleaner 45 is longer than the wiper 42 in the main scanning direction. The wiper cleaners 44, 45 are always located at their respective positions that are distant from the face 8*a*.

A shaft 44*x* extending in the sub-scanning direction is fitted in and fixed to a center of the sub-wiper cleaner 44. A pulley 44*p*1 is provided on one end of the shaft 44*x*. A motor 44M and a pulley 44*p*2 fixed to an output shaft of the motor 44M are disposed on a lower side of the pulley 44*p*1. A belt 44*b* is wound around the pulleys 44*p*1, 44*p*2. When the pulley 44*p*2 is rotated by the motor 44M, the belt 44*b* is circulated, which rotates the pulley 44*p*1 with the shaft 44*x*. As a result, the sub-wiper cleaner 44 is rotated about the shaft 44*x*.

A shaft 45*x* extending in the main scanning direction is fitted in and fixed to a center of the wiper cleaner 45. A pulley 45*p*1 is provided on one end of the shaft 45*x*. A motor 45M and a pulley 45*p*2 fixed to an output shaft of the motor 45M are disposed at positions distant from the pulley 45*p*1 in the sub-scanning direction. A belt 45*b* is wound around the pulleys 45*p*1, 45*p*2. When the pulley 45*p*2 is rotated by the motor 45M, the belt 45*b* is circulated, which rotates the pulley 45*p*1 with the shaft 45*x*. As a result, the wiper cleaner 45 is rotated about the shaft 45*x*.

The wipers 41, 42 and components for supporting the wiper cleaners 44, 45 (such as the bars 41*b* and the shafts 42*x*, 44*x*, 45*x*) are supported by a frame 50 movable upward and downward relative to the casing 1*a*. Teeth 50*t* meshable with teeth of a gear 50*g* are formed on an end face of a one-side face of the frame 50. When the gear 50*g* is rotated forwardly or reversely by a motor 50M, the frame 50 is moved upward or downward in the vertical direction. As a result, the shaft 42*x* and the shaft 45*x* are moved upward and downward in the vertical direction while respectively supporting the wiper 42 and the wiper cleaner 45.

Figure 8:
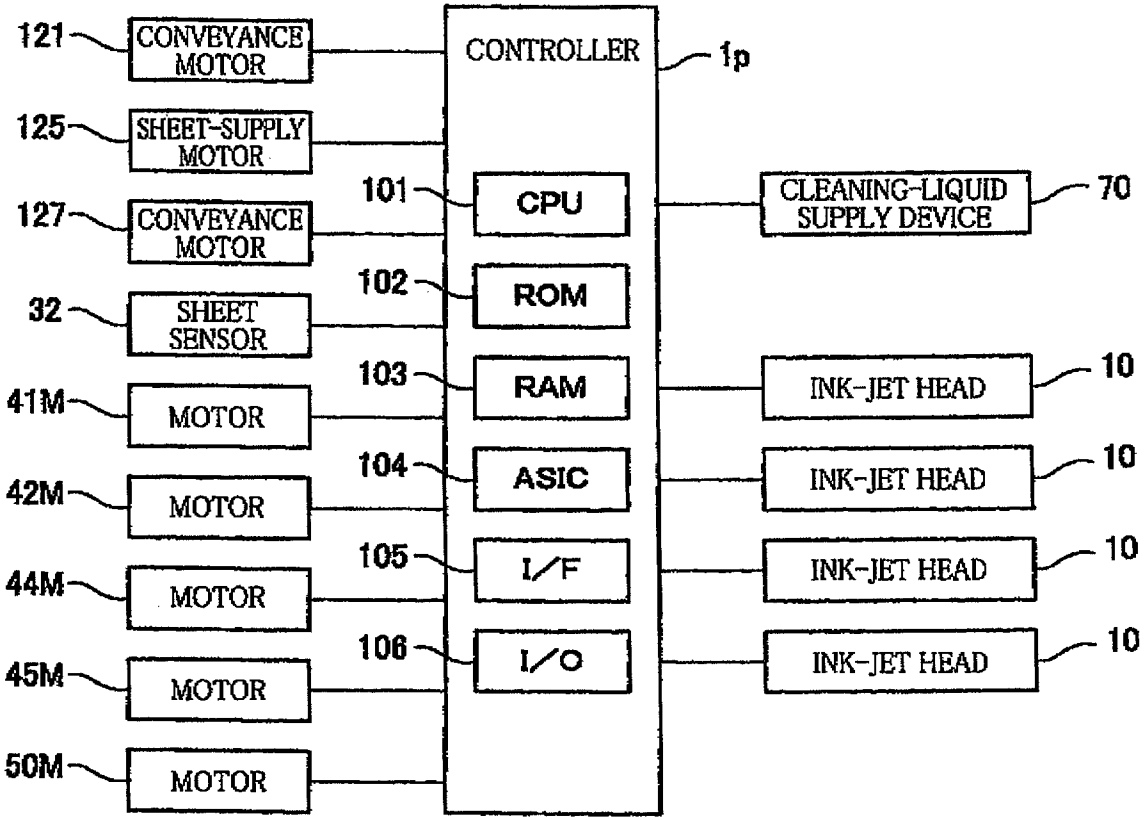
FIG. 8 is a block diagram showing an electric configuration of the printer in FIG. 1.

There will be next explained an electric configuration of the printer 1 with reference to FIG. 8.

As shown in FIG. 8, the controller 1*p* includes a Central Processing Unit (CPU) 101, a Read Only Memory (ROM) 102, a Random Access Memory (RAM) 103 such as a non-volatile RAM, an Application Specific Integrated Circuit (ASIC) 104, an interface (11F) 105, an Input/Output Port (I/O) 106, and so on. The ROM 102 stores therein programs executed by the CPU 101, various fixed data, and so on. The RAM 103 temporarily stores therein data required for the execution of the programs, such as image data relating to an image to be formed on the sheet P. The ASIC 104 performs, e.g., rewriting and sorting of the image data. Specifically, the ASIC 104 performs a signal processing and an image processing, for example. The I/F 105 transmits or receives data to or from the external device. The I/O 106 inputs or outputs detection signals of various sensors.

The controller 1*p* is connected to the motors 121, 125, 127, 41M, 42M, 44M, 45M, 50M, the sheet sensor 32, the control board of the head 10, the cleaning-liquid supply device 70 and other components.

There will be next explained a wiping control executed by the controller 1*p* with reference to FIGS. 9 and 10A-10E. The following processings are executed by the CPU 101 in accordance with the program stored in the ROM 102. It is noted that FIG. 10 omits illustrations of the sub-wiper 41 and the sub-wiper cleaner 44.

Figure 9:
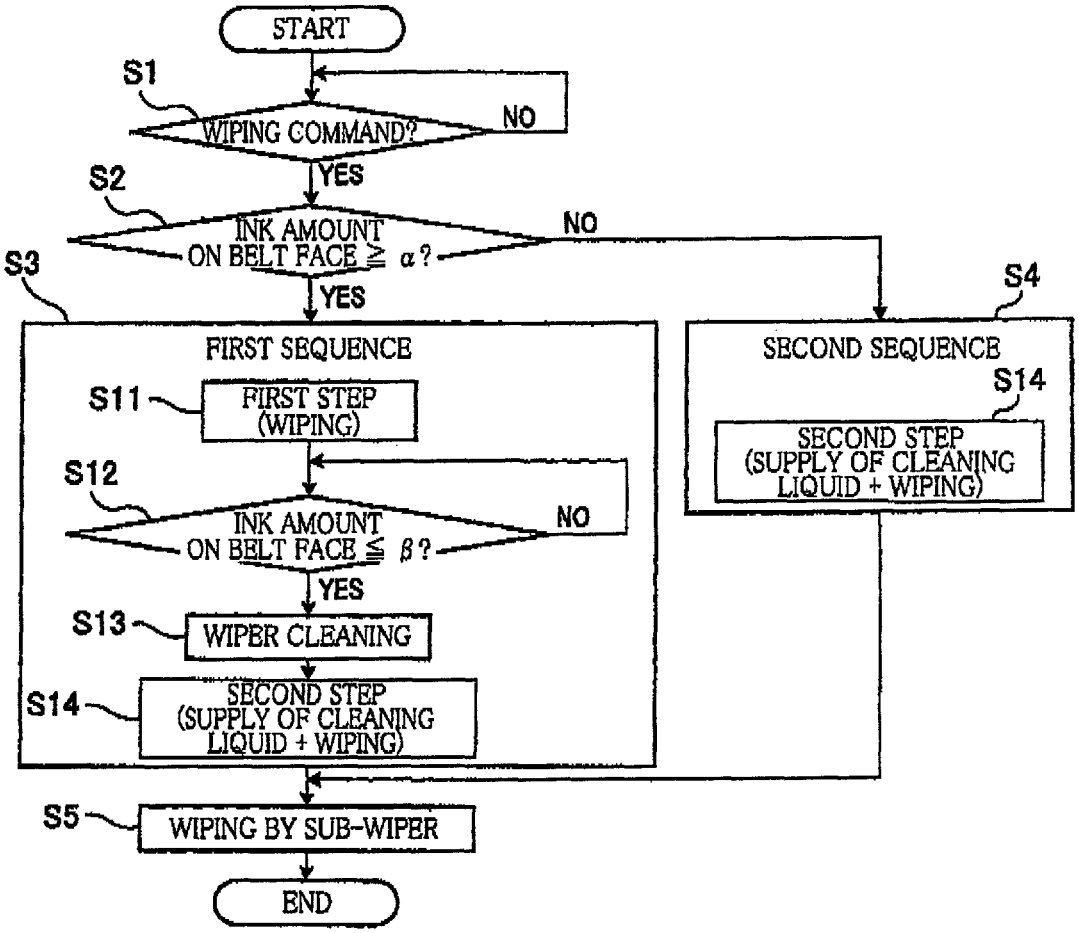
FIG. 9 is a flow-chart showing a control of a wiping executed by a controller of the printer in FIG. 1.

As shown in FIG. 9, the controller 1*p* in S1 judges whether a wiping command has been received or not. The controller 1*p* receives the wiping command in the following cases: (i) after preliminary ejection is performed; (ii) when a jamming of the sheet P occurs in the sheet conveyance path in the casing 1*a*; and the like. The preliminary ejection is ejection of the ink from the head 10 at a timing different from that of the recording, and the preliminary ejection includes purging (that is an operation for driving a pump so as to apply pressures to the ink in the head 10 to eject the ink from the ejection openings 14*a*) and flushing (that is an operation for driving the actuators of the head 10 on the basis of flushing data (different from the image data) to eject the ink from the ejection openings 14*a*). Whether the head 10 performs the purging or the flushing is determined depending upon a situation. For example, the purging is performed after the printer 1 is turned on, when the sheet Jamming has occurred (the above-described case (ii)), or when no recording command has not been received for equal to or longer than a predetermined length of time after the recording has been completed on the basis of the recording command, and the flushing is performed after the recording is completed on a predetermined number of the sheets P in successive recording (i.e., in recording for a plurality of the sheets P) and before the recording starts to be performed on the next sheet P.

When having received the wiping command (S1: YES), the controller 1*p* estimates an amount of the ink on the face 8*a*, and judges in S2 whether or not the estimated ink amount is equal to or greater than a predetermined amount $\alpha$. In this processing, the controller 1*p* estimates the amount of the ink on the face 8*a* on the basis of a type of the preliminary ejection (i.e., the purging or the flushing) where the preliminary ejection has been performed before S2 (the above-described case (i)), and the controller 1*p* estimates the amount of the ink on the face 8*a* on the basis of image data where the sheet jamming has occurred before S2 (the above-described case (ii)) and the preliminary ejection has not been performed, for example. An amount of the ink to be ejected is larger in the purging than in the flushing. Thus, it is estimated that the ink having an amount that is equal to or greater than the predetermined amount a exists on the face 8*a* where the purging has been performed before S2, and it is estimated that the ink having an amount that is less than the predetermined amount a exists on the face 8*a* where the flushing has been performed before S2. In the case of the sheet jamming, the amount of the ink ejected by the head 10 can be obtained on the basis of the image data used in the recording during which the sheet jamming has occurred, and the amount of the ink on the face 8*a* can be estimated assuming that all the ejected ink has been landed on the face 8*a* (not on the sheet P). Here, where the amount of the ink on the face 8*a* is equal to or greater than the predetermined amount $\alpha$, a degree of lowering of a density of the ink on the face 8*a* upon supplying the cleaning liquid from the cleaning-liquid supply device 70 is relatively low when compared with a case where the amount of the ink on the face 8*a* is less than the predetermined amount $\alpha$, whereby the density of the ink remaining on the face 8*a* after the wiping is relatively high. This makes it easy for the ink to adhere to the sheet P. It is noted that the ink and the face 8*a* are attracted and bonded to each other by an intermolecular force therebetween and by entrance of the ink into fine recessions and projections on the face 8*a*, but when cleaning liquid having a high affinity for the ink is supplied (such as cleaning liquid mainly composed of water in the case of aqueous (water-based) ink), the ink on the face 8*a* diffuses in the cleaning liquid. It is impossible to remove all the ink (the cleaning liquid) from the face 8*a* by the wiping, and thus a considerably small amount of the ink (the cleaning liquid) always remains on the face 8*a*. The predetermined amount is set at any value and obtained by experiment, for example.

Where the controller 1*p* has judged that the estimated ink amount is equal to or greater than the predetermined amount a (S2: YES), the controller 1*p* in S3 executes a first sequence (as one example of a first cleaning operation). The first sequence S3 includes a first step (as one example of a first operation) S11, a wiper cleaning S13, and a second step (as one example of a second operation) S14. Here, the first sequence S3 is explained in detail.

Figure 10A:
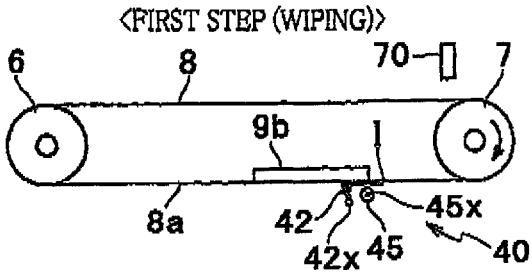
Figure 10B:
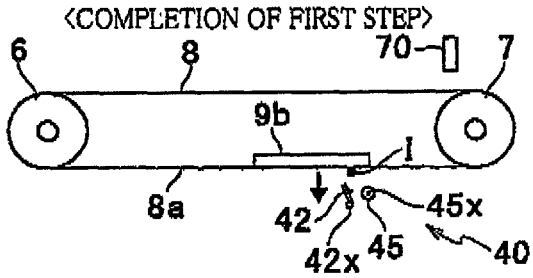
Figure 10C:
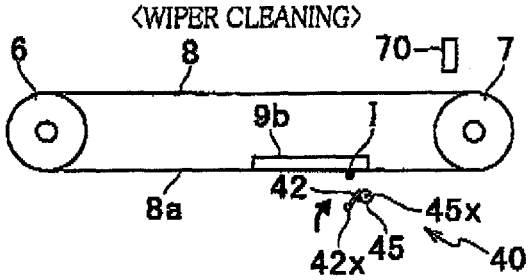

In the first sequence S3, the controller 1*p* executes the first step S11 in which, as shown in FIG. 10A, the wiper 42 wipes the face 8*a* without the supply of the cleaning liquid by the cleaning-liquid supply device 70. In this processing, the controller 1*p* first drives the motor 42M to rotate the shaft 42*x*. As a result, the wiper 42 located at the position distant from the face 8*a* is moved to a position in which the main body 42*a* is at an inclination angle θ1 (see FIG. 5A), and the distal end thereof is held in deforming contact with the face 8*a*. The controller 1*p* drives the conveyance motor 121 to circulate the conveyance belt 8 in a state in which the wiper 42 is held or located at a position thereof indicated in FIG. 5A. As a result, ink I on the face 8*a* runs down the distal end of the main body 42*a* and is received by the receiving tray, not shown, that is, the ink I is removed from the face 8*a*. As thus described, an amount of the ink I on the face 8*a* is reduced by the first step S11.

It is noted that settings of an area on the face 8*a* to be wiped in the first step S11, a running amount of the conveyance belt 8, and the like can be appropriately performed. For example, where the controller 1*p* has identified an area on the face 8*a* on which the ink I has been landed, the controller 1*p* may wipe only the identified area. On the other hand, where the controller 1*p* has not identified any area on the face 8*a* on which the ink I has been landed, the controller 1*p* may circulate the conveyance belt 8 for equal or more than one circulation to wipe the entire face 8*a* of the conveyance belt 8 in its circumferential direction.

After the start of the first step S11, the controller 1*p* judges in S12 whether or not the amount of the ink I on the face 8*a* has become equal to or less than a predetermined amount β. In this processing, the controller 1*p* judges that the amount of the ink I on the face 8*a* has become equal to or less than the predetermined amount β (S12: YES) where the wiping of the above-described identified area on which the ink I has been landed is completed in the first step S11 or where the wiping of the entire face 8*a* of the conveyance belt 8 in its circumferential direction is completed, for example. Where the wiping of the area on which the ink I has been landed is completed or where the wiping of the entire face 8*a* of the conveyance belt 8 in its circumferential direction is completed, at least the area of the face 8*a* on which the ink has been landed is in a state in which the wiping has been performed by the wiper 42. That is, the area is in a state in which the ink has been removed by the wiper 42. Thus, an amount of the ink remaining on the face 8*a* is extremely small, whereby good wiping performance can be obtained where the cleaning liquid is supplied by the cleaning-liquid supply device 70. That is, whether or not the amount of the ink I on the face 8*a* is equal to or less than the predetermined amount β is judged on the basis of whether the area of the face 8*a* on which the ink had been landed has been wiped by the wiper 42 when the controller 1*p* has received the wiping command.

Where the controller 1*p* has judged that the amount of the ink I on the face 8*a* has become equal to or less than the predetermined amount β (S12: YES), the controller 1*p* completes the first step S11 and performs the wiper cleaning in S13. When the first step S11 is completed, the controller 1*p* stops the driving of the conveyance motor 121 to stop the conveyance belt 8. The controller 1*p* then drives the motor 50M to lower the frame 50 together with the wiper 42 and the wiper cleaner 45 (see FIG. 10B). As a result, the wiper 42 comes off or is released from the face 8*a*. The ink I held on the distal end of the main body 42*a* may remain on an area on the face 8*a* at which the wiper 42 has been released. Thus, the controller 1*p* drives the motor 42M to rotate the wiper 42 once about the shaft 42*x* in a clockwise direction in FIG. 1 (see FIG. 10C). In this rotation, the distal end of the main body 42*a* is brought in deforming contact with an outer circumferential face of the wiper cleaner 45. As a result, the foreign matters attached on the distal end of the main body 42*a* are removed by the wiper cleaner 45.

Figure 10D:
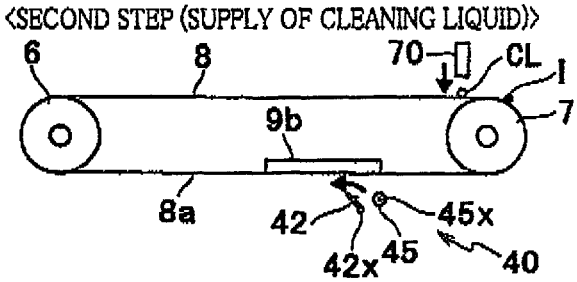
Figure 10E:
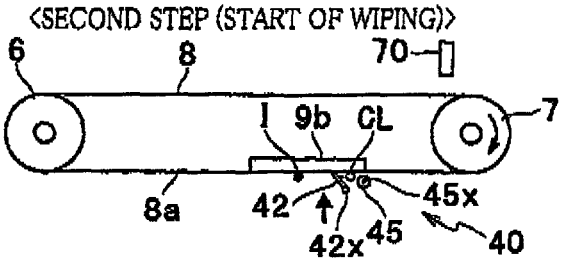

After S13, the controller 1*p* executes a second step S14 in which, as shown in FIG. 10D, the cleaning liquid is supplied by the cleaning-liquid supply device 70, and then as shown in FIG. 10E, the face 8*a* is wiped by the wiper 42 (noted that the ink ejection onto the sheet P is not performed between the first step S11 and the second step S14). In this processing, the controller 1*p* controls the conveyance motor 121 to circulate the conveyance belt 8 and then to stop the conveyance belt 8 at a timing when a position on the face 8*a* at which the wiper 42 has been released from the face 8*a* at the completion of the first step S11 (hereinafter may be referred to as "released position of the wiper 42") has reached a position located on a downstream side of the cleaning-liquid supply device 70 in the belt running direction (that is, when a state shown in FIG. 10D has been established). It is noted that the released position of the wiper 42 is a position of the ink I in FIGS. 10B-10D. The controller 1*p* then controls the cleaning-liquid supply device 70 to eject the cleaning liquid CL onto an area on the face 8*a* which is located on a downstream side of the above-described released position in the relative movement direction. Here, an amount of the cleaning liquid CL supplied by the cleaning-liquid supply device 70 is constant regardless of the amount of the ink on the face 8*a* which has been estimated in S2. As a result, it is possible to reduce a consumption of the cleaning liquid CL. The controller 1*p* then controls the conveyance motor 121 to circulate the conveyance belt 8 and then to stop the conveyance belt 8 at a timing when an area on the face 8*a* which is located on a downstream side of the above-described released position in the relative movement direction and on an upstream side of the position at which the cleaning liquid CL has been supplied in the relative movement direction (i.e., an area on the face 8*a* between the ink I and the cleaning liquid CL in FIG. 10E) is positioned just over (or positioned at a position opposed to) the distal end of the main body 42*a*. The controller 1*p* then controls the motor 50M to raise the shaft 42*x* and controls the motor 42M to rotate the shaft 42*x* to move the wiper 42 located at the position distant from the face 8*a*, to a position (see FIG. 10E) at which the main body 42*a* is held into deforming contact with the face 8*a* so as to be at an inclination angle θ2 (see FIG. 5B). In this operation, the distal end of the main body 42*a* contacts the above-described area on the face 8*a* (i.e., as shown in FIG. 10E, the area on the face 8*a* which is located on a right side of the ink I and on a left side of the cleaning liquid CL). The controller 1*p* then controls the conveyance motor 121 to circulate the conveyance belt 8 in a state in which the wiper 42 is kept at the position shown, in FIG. 5B. As a result, the wiping is performed in a state in which the cleaning liquid CL is held between the wall 42*b* and the distal end of the main body 42*a* (the contactable portion of the wiper 42 which is contactable with the face 8*a*), more specifically, a portion of the wiper 42 near the distal end of the main body 42*a*, whereby the ink I on the face 8*a* is removed together with the cleaning liquid CL. That is, when the conveyance belt 8 is circulated from its position shown in FIG. 10E, the cleaning liquid CL is brought into contact with the distal end of the main body 42*a*. The conveyance belt 8 is circulated in the state in which the cleaning liquid CL is held on the main body 42*a*. When the conveyance belt 8 has made about one circulation or rotation, the ink I contacts the distal end of the main body 42*a*. That is, in this construction, it is possible to reduce an area for which the wiping is performed by the wiper 42 in a state in which the cleaning liquid CL is mixed with the ink I attached to the released position of the wiper 42 at the completion of the first step S11. Thus, the good wiping performance can be obtained.

It is noted that, a face of the wall 42*b* near the distal end of the main body 42*a* (i.e., an upper face thereof in FIGS. 5A and 5B) extends obliquely downward (in a direction including the downward component in the vertical direction) in the first step S11 and extends in a horizontal direction or obliquely upward (in a direction including an upward component in the vertical direction) in the second step S14. As a result, in the second step S14, the cleaning liquid can be effectively held on the distal end of the main body 42*a*. As shown in FIGS. 5A and 5B, a height of the shaft 42*x* in the wiping in the second step S14 is set such that a pressure of the wiper 42 on the face 8*a* is greater than that in the first step S11. The pressure per a unit area is calculated by an expression "Q/S" (The sign "Q" represents a force applied to the portion of the face 8*a* which is contacted by the wiper 42, and the sign "S" represents an area (size) of the portion of the face 8*a* which is contacted by the wiper 42. The area "S" is calculated by an expression "l*d", the sign "l" represents a length of the portion of the face 8*a* which is contacted by the wiper 42 in the widthwise direction of the conveyance belt 8 (i.e., the width of the conveyance belt 8 in the present embodiment), and the sign "d" represents a length of the portion of the face 8*a* which is contacted by the wiper 42 in the circumferential direction of the conveyance belt 8 (i.e., a length of a deformed portion of the distal end of the wiper 42)). In the present embodiment, the inclination angle is smaller in the second step S14 than in the first step S11 ($\theta 2<\theta 1$), but the shaft 42*x* is located at a higher position in the second step S14 than in the first step S11. Thus, a deformation amount of the distal end of the main body 42*a* is larger in the second step S14, and accordingly the above-described pressure is larger in the second step S14. Settings of an area on the face 8*a* to be wiped in the second step S14, a running amount of the conveyance belt 8, and the like can be appropriately performed. However, the conveyance belt 8 is preferably circulated more than once for removing the ink I remaining on the face 8*a* at the completion of the first step S11. A supply amount of the cleaning liquid, a supplied position, and the like in the second step S14 can be also appropriately set. For example, even where the cleaning liquid is supplied onto an extremely small area on the face 8*a*, the cleaning liquid is spread by the wiper 42, resulting in good wiping performance. The supply amount of the cleaning liquid in S14 may be changed depending on the amount of the ink on the face 8*a* which has been estimated in 82. For example, this printer 1 may be configured such that, where the amount of the ink on the face 8*a* which has been estimated in S2 is relatively large, the supply amount of the cleaning liquid is made larger, and where the amount of the ink on the face 8*a* which has been estimated in S2 is relatively small, the supply amount of the cleaning liquid is made smaller.

Where the estimated ink amount is less than the predetermined amount a (S2: NO), the controller 1*p* in S4 executes a second sequence (as one example of a second cleaning operation). In this second sequence S4, only the second step S14 is executed without executing the first step S11. The second step S14 is explained above and thus the explanation thereof is omitted here, but the position on the face 8*a* at which the cleaning liquid CL has been supplied in this step and the contact position of the wiper 42 on the face 8*a* at the start of the wiping in this step are not limited in particular. Further, the wiper cleaning S13 may be performed before the second step S14 in the second sequence S4.

After the first sequence S3 or the second sequence S4, the controller 1*p* in S5 controls the components of the printer 1 to perform the wiping of the sub-wiper 41. In this wiping, the controller 1*p* controls the conveyance motor 121 to circulate the conveyance belt 8 and then to stop the conveyance belt 8 at a timing when a predetermined area on the face 8*a* (e.g., a released position of the wiper 42 at the completion of S14) reaches the wiping area of the sub-wiper 41. The controller 1*p* then drives the motor 41M to move the sub-wiper 41 in the main scanning direction. As described above, the sub-wiper 41 having reached the other end of the conveyance belt 8 in its widthwise direction returns to the home position after the distal end of the sub-wiper 41 is cleaned by the sub-wiper cleaner 44.

After S5, the controller 1*p* finishes the control for the wiping.

It is noted that the controller 1*p* controls the motors 44M, 45M to rotate the wiper cleaners 44, 45 by a predetermined angle smaller than 360 degrees each time when one or a plurality of times of the wiper cleanings for the wiper cleaners 44, 45 is or are finished. As a result, portions of the wiper cleaners 44, 45 which are contacted by the distal ends of the respective wipers 41, 42 during the wiper cleaning are changed, making it possible to effectively remove the foreign matters attached on the distal ends of the respective wipers 41, 42.

In view of the above, the controller 1*p* can be considered to include a cleaning-operation executing section configured to execute the first sequence, for example. Further the controller 1*p* can be considered to include a judging section configured to estimate the amount of the ink on the face 8*a* and judges whether or not the estimated ink amount is equal to or greater than a predetermined amount $\alpha$.

As described above, in the printer 1 as the present embodiment, the cleaning liquid is supplied, and the wiping is performed after the ink amount is reduced in the first step S11. As a result, good wiping can be performed while preventing cleaning ability (effect) of the cleaning liquid from decreasing.

In this printer 1, the amount of the cleaning liquid supplied onto the face 8*a* in the first step S11 is zero which is less than the amount of the cleaning liquid supplied onto the face 8*a* in the second step S14. As a result, it is possible to reduce the consumption of the cleaning liquid.

In this printer 1, where the amount of the ink on the face 8*a* has become equal to or less than the predetermined amount $\beta$ (S12: YES), the controller 1*p* goes to the second step S14 from the first step S11. In this case, the second step S14 is executed after the ink amount is reduced in the first step S11 to become equal to or less than the predetermined amount $\beta$, making it possible to reliably obtain the above-described effect in which the cleaning liquid can be effectively used to perform the good wiping.

In this printer 1, the pressure of the wiper 42 on the face 8*a* in the first step S11 is less than the pressure of the wiper 42 on the face 8*a* in the second step S14. In this case, it is possible to reduce wear of the wiper 42 used in the first step S11 to perform the good wiping.

In this printer 1, the controller 1*p* in 52 estimates the amount of the ink on the face 8*a* and judges whether or not the estimated ink amount is equal to or greater than the predetermined amount α. Where the controller 1*p* has judged that the estimated ink amount is less than the predetermined amount α, the second sequence S4 in which the second step S14 is executed without executing the first step S11. On the other hand, where the controller 1*p* has judged that the estimated ink amount is equal to or greater than the predetermined amount α, the first sequence S3 is executed. That is, where the amount of the ink on the face 8*a* is relatively large, the first sequence S3 is executed (the cleaning liquid is supplied and the wiping is performed in the second step S14 after the ink amount is reduced in the first step S11). On the other hand, where the amount of the ink on the face 8*a* is relatively small, the second sequence S4 is executed (the first step S11 is omitted, and the cleaning liquid is supplied and the wiping is performed in the second step S14). As thus described, one of the two sequences is executed depending on the amount of the ink on the face 8*a*, making it possible to perform the wiping efficiently with a relatively short time without deteriorating the wiping performance.

In this printer 1, the controller 1*p* executes the first step S11 so as to reduce the amount of the ink on the face 8*a* with the wiper 42 used in the second step S14. In this case, an additional component does not need to be provided for the first step S11, which simplifies the construction of the printer 1.

In this printer 1, the controller 1*p* in S13 executes the cleaning of the wiper 42 used in the first step S11 after the completion of the first step S11 and before the start of the second step S14, and then executes the second step S14 with the cleaned wiper 42. In this case, it is possible to prevent the foreign matters attached to the wiper 42 in the first step S11 from being attached to the face 8*a* again in the second step S14, for example.

In this printer 1, when the second step S14 is started, the cleaning liquid CL is supplied onto the area on the face 8*a* which is located on a downstream side of the released position of the wiper 42 (the position of the ink I in FIG. 10D) at the completion of the first step S11 in the relative movement direction. Then, the wiper 42 is brought into contact with the area on the face 8*a* which is located on a downstream side of the above-described released position in the relative movement direction and on an upstream side of the position at which the cleaning liquid CL has been supplied in the relative movement direction (i.e., the area on the face 8*a* between the ink I and the cleaning liquid CL in FIG. 10E). In this case, it is possible to prevent the ink I held on the wiper 42 at the completion of the first step S11 (i.e., the ink remaining on the face 8*a* after the completion of the first step S11) from being mixed with the cleaning liquid CL supplied in the second step S14, thereby preventing the cleaning ability of the cleaning liquid CL from decreasing. Accordingly, it is possible to efficiently use the cleaning liquid CL in the second step S14 to perform the wiping. Further, it is possible to prevent the ink I held on the wiper 42 at the completion of the first step S11 from being spread on the face 8*a* in the second step S14.

In this printer 1, the wiper 42 is constituted by the main body 42*a* and the wall 42*b*, and the wall 42*b* can effectively hold the cleaning liquid on the distal end of the main body 42*a* (i.e., the contactable portion of the wiper 42 which is contactable with the face 8*a*) to perform the good wiping. In particular, where a viscosity of the cleaning liquid is relatively low, the cleaning liquid easily flows down on the main body 42*a*, but the wall 42*b* can prevent this.

In this printer 1, the controller 1*p* controls the motor 42M such that the inclination angle of the main body 42*a* is smaller in the second step S14 than in the first step S11 ($\theta 2<\theta 1$). In this case, the cleaning liquid can be effectively held on the distal end of the main body 42*a* (the contactable portion of the wiper 42 which is contactable with the face 8*a*) by making the inclination angle smaller. Thus, the wiping can be performed in the second step S14 while holding the cleaning liquid more reliably on the distal end of the main body 42*a*, making it possible to perform the good wiping. Since the ink is to be removed from the face 8*a* by the wiper 42 in the first step S11, the ink preferably flows down on the main body 42*a* without remaining on the distal end of the main body 42*a*. Meanwhile, the cleaning liquid and the ink are wiped by the wiper 42 in the second step S14. Since the cleaning liquid is liquid to be supplied to the ink on the face 8*a* to lower the density of the ink, the cleaning liquid preferably remains on the distal end of the main body 42*a*. Thus, in the present embodiment, the inclination angle of the main body 42*a* is controlled to be smaller in the second step S14 than in the first step S11.

There will be next explained an ink-jet printer as a second embodiment of the liquid ejection apparatus of the present invention. The printer as the second embodiment is different from the printer as the first embodiment in the wiping control executed by the controller 1*p*, but the other construction and control are the same as those of the first embodiment.

In the present embodiment, in the first sequence S3 (see FIG. 9), the controller 1*p* controls the sub-wiper 41 after the completion of the first step S11 and before the start of the second step S14 (for example, after S13 and before S14), to remove the ink I (see FIG. 10B) remaining on the face 8*a* after the completion of the first step S11.

In the present embodiment, the following advantageous effects can be obtained in addition to the above-described effects obtained by the same configuration as that of the first embodiment. That is, since the controller 1*p* goes to the second step S14 after the ink I remaining on the face 8*a* after the completion of the first step S11 is removed by the sub-wiper 41, it is possible to prevent the mixture of the ink I and the cleaning liquid CL from decreasing the cleaning ability of the cleaning liquid CL, resulting in the good wiping performance. It is noted that, in the present embodiment, the position on the face 8*a* onto which the cleaning liquid CL has been supplied and the contact position of the wiper 42 on the face 8*a* at the start of the wiping in the second step S14 in the first sequence S3 are not limited in particular.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

The conveyance member is not limited to the conveyance belt and may be a rotational drum, for example.

The cleaning-liquid supply portion may have any construction. For example, the cleaning-liquid supply portion may have the same construction as that of the liquid ejection head configured to eject the recording liquid. Further, the cleaning-liquid supply portion may be a sprayer for spraying the cleaning liquid or a component for coating the cleaning liquid.

The wiper cleaner may be a rotatable brush instead of the sponge, for example. Further, the wiper cleaner and the wiper cleaning using this may be omitted.

The wall of the wiper does not need to be formed integrally with the main body. For example, there may be employed a component independent of the main body (e.g., a component having high rigidity), and bonded to the main body or movable so as to come into contact with or come off the main body. Further, the wall may be omitted. The wall may be provided on only a part of the portion of the main body which is contactable with the face of the conveyance member. The wiper is not limited to have the plate shape and may have various shapes such as a circular cylinder roller as long as the wiper can wipe the face of the conveyance member by moving relative to the face while contacting the face. A material of the wiper is not limited in particular. The sub-wiper and the wiping using this may be omitted.

In the wiping of each wiper, the wiper and the face of the conveyance member only need to move relatively to each other. That is, the face of the conveyance member may be moved in a state in which the wiper is at rest, and the wiper may be moved in a state in which the face of the conveyance member is at rest, and both of the wiper and the face of the conveyance member may be moved.

The inclination angle of the wiper with respect to the face of the conveyance member in the wiping is not limited in particular. Further, the inclination angle may be the same between the first step and the second step.

In addition to the height of the wiper and/or the angle of the wiper with respect to the face of the conveyance member, the pressure of the wiper on the face of the conveyance member may be adjusted by using wipers whose materials and/or sizes (e.g., lengths, widths, thicknesses) are different from each other (that is, the printer may be configured such that the different wipers are used for the wipings in the first step and the second step in the first sequence, and the above-described pressures of the wipers are adjusted). Further, such an adjustment of the pressure may not be performed (for example, the above-described pressures may be the same as each other in the first step and the second step of the first sequence).

The controller does not need to execute the control in which the amount of the ink on the face 8*a* is estimated, and one of the sequences is selected on the basis of the estimated ink amount. For example, the controller may always execute the first sequence where the wiping command has been received.

The position of the face of the conveyance member onto which the cleaning liquid is supplied and the position of the face which is contacted by the wiper at the start of the wiping in the second step of the first sequence are not limited in particular. The wipings in the first step and the second step of the first sequence may be performed by using different wipers.

The wiper used in the first step and the second step may be used where the recording liquid remaining on the face after the completion of the first step is removed after the completion of the first step and before the start of the second step. For example, the above-described remaining recording liquid is removed by the sub-wiper 41 in the second embodiment, but the printer may be configured such that the sub-wiper 41 is omitted, and the above-described remaining recording liquid is removed by the wiper 42.

The printer may be configured such that the cleaning liquid is supplied onto the face of the conveyance member in the first step, and an amount of the cleaning liquid supplied in the first step is equal to or greater than the amount of the cleaning liquid supplied onto the face of the conveyance member in the second step. Further, the amount of the cleaning liquid is supplied onto the face of the conveyance member in the first step may be equal to or less than the amount of the cleaning liquid supplied onto the face of the conveyance member in the second step. The first step is not limited to the wiping using the wiper as long as the amount of the recording liquid on the face of the conveyance member is reduced in the first step. For example, the first step may be a step for removing the recording liquid on the face by a non-contact device or component for removing the recording liquid using an electrostatic force, an air sucking force, an air discharge force, and the like without contacting the face.

Further, in the above-described embodiments, as shown in FIG. 10D, the conveyance belt 8 is stopped and the cleaning liquid CL is ejected onto the area on the face 8*a* which is located on a downstream side of the above-described released position in the relative movement direction at the timing when the released position of the wiper 42 at the completion of the first step S11 has reached the area on the face 8*a* which is located on a downstream side of the cleaning-liquid supply device 70 in the belt running direction, but the present invention is not limited to this configuration. For example, the printer may be configured such that the conveyance belt 8 is stopped before the released position of the wiper 42 at the completion of the first step S11 has reached the area on the face 8*a* which is located on a downstream side of the cleaning-liquid supply device 70 in the belt running direction (that is, when the released position of the wiper 42 at the completion of the first step S11 is located on an upstream side of the cleaning-liquid supply device 70 in the belt running direction), and the cleaning liquid CL is ejected onto an area on the face 8*a* which is located on an upstream side of the above-described released position in the relative movement direction. In this case, where, as in the above-described embodiment, the wiper 42 is brought into contact with the area on the face 8*a* which is located on a downstream side of the above-described released position in the relative movement direction and on an upstream side of the position at which the cleaning liquid CL has been supplied in the relative movement direction, the cleaning liquid CL is removed before the ink I on the face 8*a*. This makes it possible to perform the wiping in a state in which the cleaning liquid CL is held on the distal end of the main body 42*a*, thereby obtaining the good wiping performance. Further, where the control in S11 in FIG. 9 is for executing the wiping of the wiper 42 from the start to the end thereof, the completion of the control in S11 means that the area on the face 8*a* to which the ink is attached has been wiped by the wiper 42. Thus, it is possible to omit the judgment in S12.

The present invention is applicable to any of a line printer and a serial printer. Further, the present invention is applicable to not only the printer but also another liquid ejection apparatus such as a facsimile machine and a copying machine. The present invention is also applicable to a recording apparatus configured to record an image by ejecting liquid other than the ink.

The recording medium is not limited to the sheet P and may be various recording media.

What is claimed is:

1. A liquid ejection apparatus comprising:

a liquid ejection head having an ejection face in which a plurality of ejection openings are formed, the liquid ejection head being configured to eject recording liquid through the plurality of ejection openings;

a conveyance member having a face that is disposed so as to be opposed to the ejection face and that is moved while supporting a recording medium thereon to convey the recording medium;

a cleaning-liquid supply portion configured to supply cleaning liquid onto the face;

a wiper movable relative to the face while contacting the face to remove the recording liquid existing on the face;

a cleaning-operation executing section configured to execute a first cleaning operation including (i) a first operation for reducing an amount of the recording liquid on the face and (ii) a second operation in which the cleaning liquid is supplied onto the face by the cleaning-liquid supply portion after the first operation, and then the recording liquid and the cleaning liquid on the face are removed by the wiper; and a judging section configured to estimate an amount of the recording liquid on the face and judge whether or not the estimated amount is equal to or greater than a second predetermined amount, wherein, where the judging section has not judged that the estimated amount is equal to or greater than the second predetermined amount, the cleaning-operation executing section executes, instead of the first cleaning operation, a second cleaning operation in which the second operation is performed without performing the first operation, and wherein, where the judging section has judged that the estimated amount is equal to or greater than the second predetermined amount, the cleaning-operation executing section executes the first cleaning operation.

2. The liquid ejection apparatus according to claim 1, wherein an amount of the cleaning liquid to be supplied onto the face in the first operation is less than an amount of the cleaning liquid to be supplied onto the face in the second operation.

3. The liquid ejection apparatus according to claim 1, wherein the cleaning liquid is not supplied onto the face in the first operation.

4. The liquid ejection apparatus according to claim 1, wherein the cleaning-operation executing section is configured to switch from the first operation to the second operation when the amount of the recording liquid on the face has become equal to or less than a first predetermined amount.

5. The liquid ejection apparatus according to claim 1, wherein the cleaning operation executing section is configured to reduce the amount of the recording liquid on the face with the wiper in the first operation, and wherein a pressure of the wiper on the face in the first operation is less than a pressure of the wiper on the face in the second operation.

6. The liquid ejection apparatus according to claim 1, wherein the cleaning-operation executing section is configured to perform the first operation so as to reduce the amount of the recording liquid on the face with the wiper used in the second operation.

7. The liquid ejection apparatus according to claim 1, wherein the cleaning-operation executing section is configured to execute an cleaning of the wiper used in the first operation, after a completion of the first operation and before a start of the second operation, and wherein the cleaning-operation executing section is configured to execute the second operation with the cleaned wiper.

8. The liquid ejection apparatus according to claim 1, wherein, after a completion of the first operation and before a start of the second operation, the cleaning-operation executing section controls a wiper different from the wiper to remove the recording liquid remaining on the face after the completion of the first operation.

9. The liquid ejection apparatus according to claim 1, wherein the liquid ejection head is configured not to eject the recording liquid onto the recording medium between the first operation and the second operation.

10. A liquid ejection apparatus comprising:

a liquid ejection head having an ejection face in which a plurality of ejection openings are formed, the liquid ejection head being configured to eject recording liquid through the plurality of ejection openings;

a conveyance member having a face that is disposed so as to be opposed to the ejection face and that is moved while supporting a recording medium thereon to convey the recording medium;

a cleaning-liquid supply portion configured to supply cleaning liquid onto the face;

a wiper movable relative to the face while contacting the face to remove the recording liquid existing on the face; and a cleaning-operation executing section configured to execute a first cleaning operation including (i) a first operation for reducing an amount of the recording liquid on the face and (ii) a second operation in which the cleaning liquid is supplied onto the face by the cleaning-liquid supply portion after the first operation, and then the recording liquid and the cleaning liquid on the face are removed by the wiper, wherein the cleaning-operation executing section is configured to reduce the amount of the recording liquid on the face with the wiper in the first operation and to release the wiper from the face at the completion of the first operation, and wherein the cleaning-operation executing section is configured to bring the wiper into contact with an area on the face, the area being located on a downstream side of a position on the face at which the wiper has been released in the first operation, in a relative movement direction that is a direction in which the wiper is moved relative to the face, the area being located on an upstream side of a position on the face onto which the cleaning liquid is supplied, in the relative movement direction.

11. The liquid ejection apparatus according to claim 10, wherein the cleaning-operation executing section is configured to execute the second operation such that the cleaning-liquid supply portion supplies the cleaning liquid to a position on the face which is located on a downstream side of the position thereon at which the wiper has been released in the first operation, in the relative movement direction.

12. The liquid ejection apparatus to claim 10, wherein the wiper includes:

a main body having a contactable portion thereof contactable with the face, the main body extending from the contactable portion in a direction including a downward component in a vertical direction and a downstream component in the relative movement direction; and a wall provided on a downstream side of the main body in the relative movement direction such that the cleaning liquid is held on the contactable portion.

13. The liquid ejection apparatus according to claim 10, further comprising an angle adjusting mechanism configured to adjust an inclination angle of the wiper with respect to the face as seen in a direction parallel to the face and perpendicular to a relative movement direction in which the wiper is moved relative to the face, wherein the cleaning-operation executing section is configured to control the angle adjusting mechanism such that the inclination angle toward a downstream side of the wiper in the relative movement direction in the second operation is less than the inclination angle toward a downstream side of the wiper in the relative movement direction in the first operation.

14. A non-transitory storage medium storing a program to be executed by a liquid ejection apparatus, the liquid ejection apparatus comprising:

a liquid ejection head having an ejection face in which a plurality of ejection openings are formed, the liquid ejection head being configured to eject recording liquid through the plurality of ejection openings;

a conveyance member having a face that is disposed so as to be opposed to the ejection face and that is moved while supporting a recording medium thereon to convey the recording medium;

a cleaning-liquid supply portion configured to supply cleaning liquid onto the face; and a wiper movable relative to the face while contacting the face to remove the recording liquid existing on the face, wherein the program is designed to execute a first cleaning operation including (i) a first operation for reducing an amount of the recording liquid on the face and (ii) a second operation in which the cleaning liquid is supplied onto the face by the cleaning-liquid supply portion after the first operation, and then the recording liquid and the cleaning liquid on the face are removed by the wiper and is designed to estimate an amount of the recording liquid on the face and judge whether or not the estimated amount is equal to or greater than a second predetermined amount, wherein, where it has not been judged that the estimated amount is equal to or greater than the second predetermined amount, the program is designed to execute, instead of the first cleaning operation, a second cleaning operation in which the second operation is performed without performing the first operation, and wherein, where it has been judged that the estimated amount is equal to or greater than the second predetermined amount, the program is designed to execute the first cleaning operation.

15. A non-transitory storage medium storing a program to be executed by a liquid ejection apparatus, the liquid ejection apparatus comprising:

a liquid ejection head having an ejection face in which a plurality of ejection openings are formed, the liquid ejection head being configured to eject recording liquid through the plurality of ejection openings;

a conveyance member having a face that is disposed so as to be opposed to the ejection face and that is moved while supporting a recording medium thereon to convey the recording medium;

a cleaning-liquid supply portion configured to supply cleaning liquid onto the face; and a wiper movable relative to the face while contacting the face to remove the recording liquid existing on the face, wherein the program is designed to execute a first cleaning operation including (i) a first operation for reducing an amount of the recording liquid on the face and (ii) a second operation in which the cleaning liquid is supplied onto the face by the cleaning-liquid supply portion after the first operation, and then the recording liquid and the cleaning liquid on the face are removed by the wiper, wherein the program is designed to reduce the amount of the recording liquid on the face with the wiper in the first operation and to release the wiper from the face at the completion of the first operation, and wherein the program is designed to bring the wiper into contact with an area on the face, the area being located on a downstream side of a position on the face at which the wiper has been released in the first operation, in a relative movement direction that is a direction in which the wiper is moved relative to the face, the area being located on an upstream side of a position on the face onto which the cleaning liquid is supplied, in the relative movement direction.

* * * * *